US006851887B2

(12) United States Patent
Lembo

(10) Patent No.: US 6,851,887 B2
(45) Date of Patent: Feb. 8, 2005

(54) ROADWAY BARRIER SYSTEM WITH RESTRAINING BRACKET AND METHOD OF INSTALLATION

(76) Inventor: Carl Lembo, 10119 Caddo Dr., Magnolia, TX (US) 77355

( * ) Notice: Subject to any disclaimer, the term of this patent is extended or adjusted under 35 U.S.C. 154(b) by 73 days.

(21) Appl. No.: 10/374,791

(22) Filed: Feb. 24, 2003

(65) Prior Publication Data

US 2003/0161683 A1 Aug. 28, 2003

Related U.S. Application Data

(60) Provisional application No. 60/358,731, filed on Feb. 25, 2002.

(51) Int. Cl.[7] ..... E01F 13/00
(52) U.S. Cl. ..... 404/6
(58) Field of Search ..... 404/6, 9; 248/680, 248/188.8, 188.91, 500, 506; 103/382, 403

(56) References Cited

U.S. PATENT DOCUMENTS

| | | | | | |
|---|---|---|---|---|---|
| 2,509,274 | A | | 5/1950 | Nugey | 267/70 |
| 3,082,994 | A | | 3/1963 | Rasmussen | 256/13.1 |
| 4,068,968 | A | | 1/1978 | Gagle et al. | 404/7 |
| 4,111,401 | A | | 9/1978 | Pickett | 256/13.1 |
| 4,138,095 | A | | 2/1979 | Humphrey | 256/64 |
| 4,307,973 | A | * | 12/1981 | Glaesener | 404/6 |
| 4,423,854 | A | | 1/1984 | Cobb et al. | 256/13.1 |
| 4,433,831 | A | | 2/1984 | Bunger | 256/39 |
| 4,463,934 | A | | 8/1984 | Ochoa et al. | 256/13.1 |
| 4,632,598 | A | | 12/1986 | Richards | 404/6 |
| 4,636,108 | A | | 1/1987 | Duckett | 404/10 |
| 4,641,993 | A | | 2/1987 | Hahne | 404/4 |
| 4,806,044 | A | | 2/1989 | Duckett | 404/6 |
| 4,815,889 | A | | 3/1989 | Duckett | 404/6 |
| 4,828,425 | A | | 5/1989 | Duckett | 404/6 |
| 4,881,845 | A | | 11/1989 | McKay | 404/6 |
| 4,919,563 | A | | 4/1990 | Stice | 404/6 |
| 4,955,753 | A | | 9/1990 | McKay | 404/6 |
| 5,046,884 | A | | 9/1991 | Girotti | 404/6 |
| 5,054,954 | A | | 10/1991 | Cobb et al. | 404/6 |
| 5,074,704 | A | | 12/1991 | McKay | 404/6 |
| 5,118,216 | A | | 6/1992 | Smith | 404/6 |
| 5,156,485 | A | * | 10/1992 | Ivey et al. | 404/6 |
| 5,165,485 | A | * | 11/1992 | Fujikawa et al. | 172/15 |
| 5,246,305 | A | | 9/1993 | Peek | 404/6 |
| 5,253,951 | A | | 10/1993 | Peek | 404/6 |
| 5,286,136 | A | | 2/1994 | Mandish et al. | 404/6 |
| 5,292,467 | A | * | 3/1994 | Mandish et al. | 264/112 |
| 5,387,049 | A | | 2/1995 | Duckett | 404/6 |
| 5,406,039 | A | * | 4/1995 | Rerup et al. | 181/210 |
| 5,685,665 | A | | 11/1997 | Lembo | 404/6 |
| 6,164,865 | A | * | 12/2000 | McCallum | 404/6 |
| 6,276,667 | B1 | | 8/2001 | Arthur | 256/13.1 |
| 6,428,237 | B1 | | 8/2002 | Duckett | 404/6 |
| 6,439,802 | B1 | | 8/2002 | Duckett | 404/6 |
| 6,485,224 | B1 | * | 11/2002 | Dyke et al. | 404/6 |
| 6,517,279 | B1 | * | 2/2003 | Camomilla et al. | 404/6 |

* cited by examiner

*Primary Examiner*—Thomas B. Will
*Assistant Examiner*—Raymond W Addie
(74) *Attorney, Agent, or Firm*—Gary L. Bush; Andrews Kurth LLP

(57) ABSTRACT

Roadway barrier system which resists lateral movement from roadway forces and thermal transients, accomplished by placing a plurality of restraining brackets along side a plurality of preformed concrete barrier sections. The brackets are anchored to the roadway surface. The barrier system is prevented from moving laterally away from the restraining brackets by enclosing the restraining brackets with channel beams which span the restraining brackets on the side opposite the preformed barrier sections and are secured to the preformed barrier sections with through bolts or studs. This arrangement maintains alignment of the barrier system with plan location yet allows longitudinal thermal expansion and contraction.

11 Claims, 3 Drawing Sheets

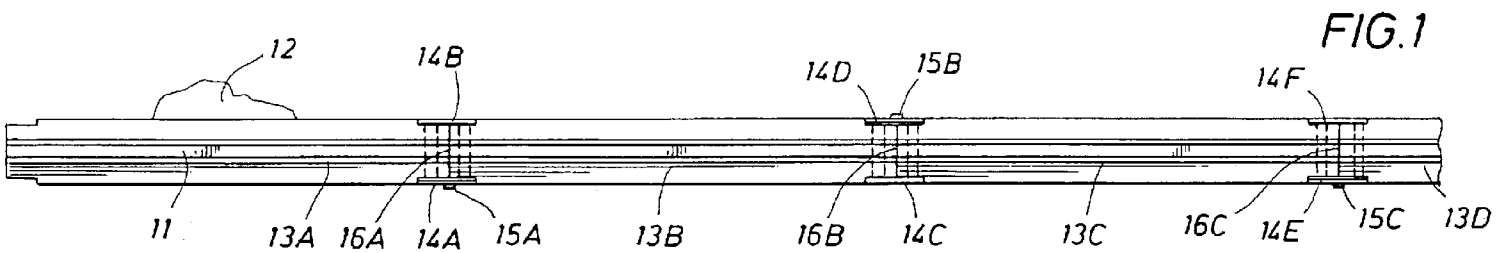
FIG.1
13D
15C
14F
14E
16C
13C
15B
14C
14D
16B
13B
15A
14B
14A
16A
13A
12
11
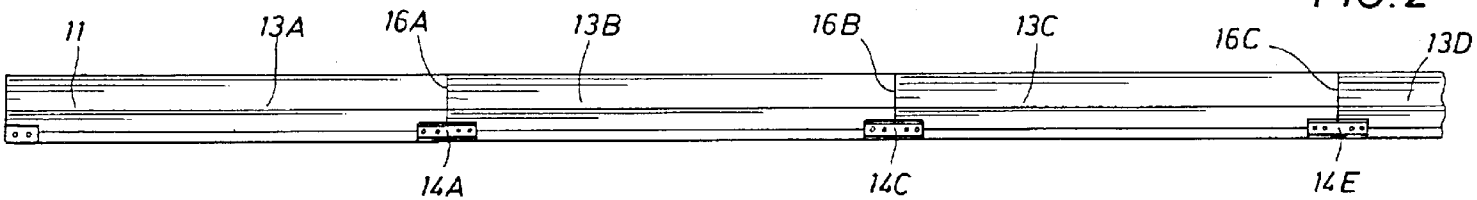
FIG.2
13D
14E
16C
13C
14C
16B
13B
14A
16A
13A
11
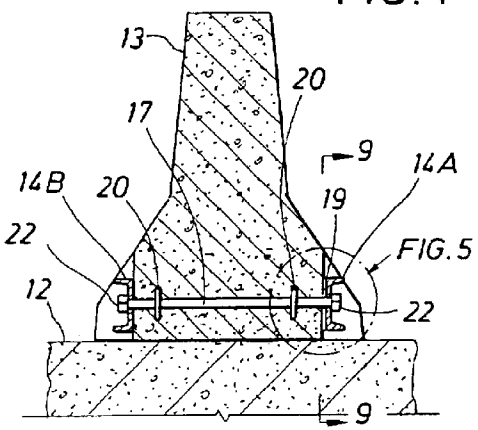
FIG.4
14A
FIG.5
22
9
19
20
13
17
20
14B
22
12
9
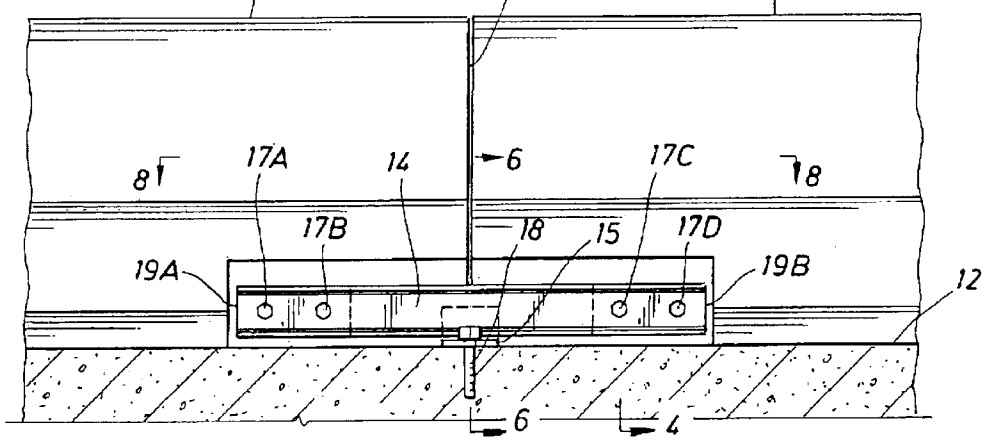
FIG.3
12
13B
8
19B
17D
17C
4
15
18
16
6
14
17B
17A
13A
19A
8
4
6

ROADWAY BARRIER SYSTEM WITH RESTRAINING BRACKET AND METHOD OF INSTALLATION

CROSS REFERENCE TO RELATED APPLICATION

This application is based upon the provisional application No. 60/358,731 filed on Feb. 25, 2002, the priority of which is claimed.

BACKGROUND OF THE INVENTION

1. Field of the Invention

This invention relates generally to a roadway barrier with restraining system and a method for its installation, and in particular to such a roadway barrier with restraining system and method of installation for resisting lateral movement from roadway vibration forces, temperature changes and vehicular impacts while allowing sufficient longitudinal movement for thermal expansion and contraction.

2. Description of Prior Art

Many roadway barriers in use today are rigid structures installed between opposing lanes of traffic to prevent head-on collisions. Often, they consist of a plurality of preformed sections of reinforced concrete. These sections are positioned in tandem on the roadway by crane or similar device and then secured together, end to end, by means of steel or like channel beams affixed with bolts or studs extending laterally through the preformed concrete sections.

Most barrier systems in use today rely solely on the weight of this system as the means of keeping the barrier in place and correctly aligned. However, these systems incur realignment maintenance costs, because they move in response to thermal expansion and contraction, roadway vibration forces and vehicle impacts.

Identification of Objects of the Invention

The principal object of the invention is to maintain the alignment of existing roadway concrete barrier systems at their plan locations, restricting lateral movement from roadway vibration forces, temperature changes and vehicle impact forces while allowing longitudinal thermal expansion and contraction.

SUMMARY OF THE INVENTION

The present invention is directed to a roadway barrier with restraining system and a method of installation, and particularly to a roadway barrier with restraining system and method of installation for resisting lateral movement from roadway vibration forces, temperature changes and low-energy vehicular impacts while allowing sufficient longitudinal movement for thermal expansion and contraction. Such a barrier maintains alignment in plan location thereby reducing realignment maintenance costs. Furthermore, the present invention augments existing barrier systems commonly in use today, such as the New Jersey type, thereby reducing costs of retrofitting existing barriers and installing new barriers.

The barrier consists of a plurality of preformed sections of reinforced concrete positioned on the roadway in tandem. Preformed barrier sections are fastened together, end to end, with two channel beams at each joint, one on each vertical side of the barrier wall, near the base. In a barrier system without the restraining system of the present invention, the channel beams overlap each preformed barrier section and are affixed to the sections by through bolts or studs. However, with the restraining system of the present invention installed, the channel beams are similarly installed except that shims are inserted laterally between one channel beam and the two barrier sections. That is, the channel beams overlap each preformed barrier section and are affixed to the sections by bolts or studs which pass laterally through the channel beam on one side of the barrier wall, through a shim, through the preformed barrier section, and finally through the other channel beam on the opposite side of the barrier wall. The assembly is secured with washers and nuts as appropriate. The channel beams are typically affixed in this fashion with two bolts or studs passing through each preformed barrier section for a total of four bolts or studs per joint.

The shims form a cavity between the preformed barrier sections and the overlapping channel beam. This thin cavity houses vertical fin of an angular steel restraining bracket of the same thickness, centered longitudinally at the joint between the two preformed barrier sections, put in place prior to securing the channel beam. The horizontal base of this restraining bracket lies parallel and adjacent to the roadway surface, protrudes laterally past the channel beam and contains a slotted hole through which a bolt is anchored into a hole in the roadway using thick asphalt. Thus, the two barrier sections, joined by the channel beams, can slide along the fixed fin of the bracket within their combined cavity. The restraining bracket prevents lateral movement of the barrier, but permits longitudinal motion, the range of which is determined by the length of the bracket and the distance between the innermost edges of the two shims. The restraining brackets are placed at alternate sides of each joint in the barrier wall, if possible, although they may all be placed on one side if required.

A barrier with the restraining system of this invention will maintain alignment in plan location by resisting lateral movement from roadway vibration forces, temperature changes and low-energy vehicular impacts while allowing sufficient longitudinal movement for thermal expansion and contraction. The barrier restraining system of this invention is directly compatible with many existing barrier systems commonly in use today, such as the New Jersey type, thereby reducing costs of retrofitting existing barriers and installing new barriers.

BRIEF DESCRIPTION OF THE DRAWING

FIGS. 1 and 2 are top and front views, respectively, of a roadway barrier of preformed concrete sections, channel beam connectors and fastening hardware, with the restraining system of the present invention, comprised of shims, restraining brackets and anchor bolts;

FIG. 3 is an enlarged front elevation of a joint formed between preformed barrier sections with an overlapping channel beam connector and restraining bracket;

FIG. 4 is an enlarged cross section view along lines 4—4 of FIG. 3 through a preformed barrier section and channel beam;

DESCRIPTION OF THE INVENTION

Figure 5:
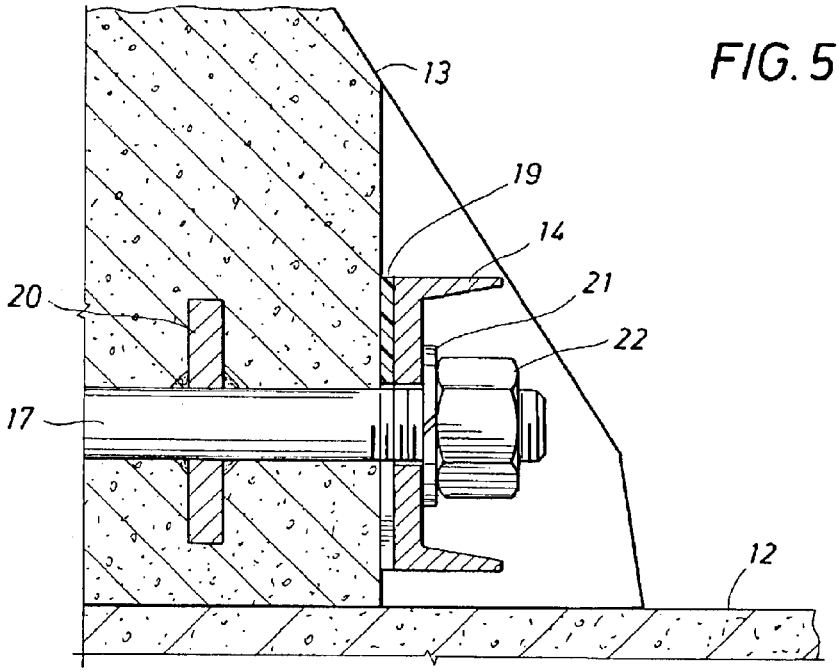
FIG. 5 is a an enlarged section of a portion of FIG. 4 illustrating shim placement between the channel beam and preformed barrier section.

Referring now particularly to FIGS. 1 and 2, the roadway barrier with the restraining system of the present invention is shown schematically in top and front views, respectively. The roadway barrier is indicated generally at 11 and is secured to the surface of the roadway 12. Barrier 11 is formed of a plurality of preformed barrier sections 13A–13D in tandem, coupled with channel beam connectors 14A–14F, and secured to roadway 12 at joints 16A–16C between barrier sections 13A–13D by restraining brackets 15A–15C. Restraining brackets 15 are placed at alternate sides of each joint 16 in barrier 11 if possible, although they may all be placed on one side if required. Two channel beams 14 span each joint 16, one on each vertical side of barrier 11. The channel beams 14A–14B are fixed to barrier sections 13A–13B with two studs 17 passing through each preformed barrier section 13 for a total of four bolts or studs per joint 16.

Figure 6:
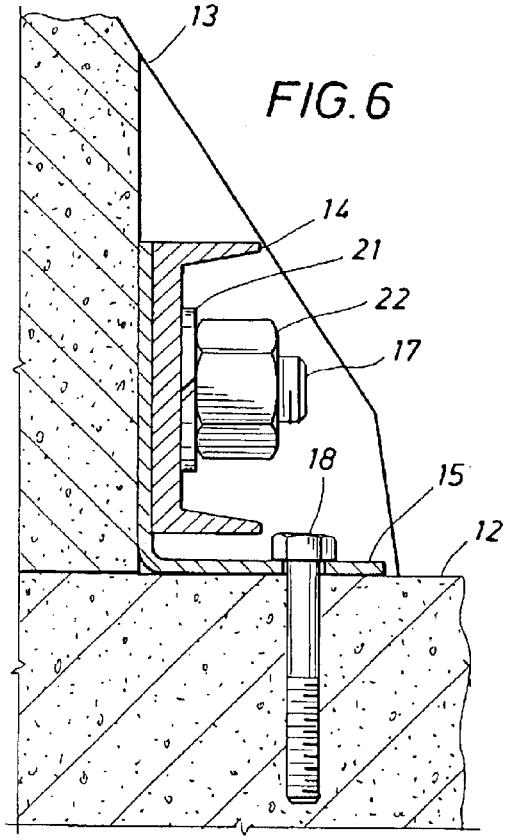
FIG. 6 is an enlarged cross section view along lines 6—6 of FIG. 3 illustrating the position of the angular restraining bracket and anchor bolt.

Referring now to FIGS. 4, 5 and 6, cross sectional views of barrier 11, the channel beams 14A and 14B are affixed to the barrier section 13 by studs 17 which pass through channel beam 14A on one side of the barrier wall, through a shim 19, through the preformed barrier section 13, and finally through the other channel beam 14B on the opposite side of barrier 11. While the studs 17 in this design have anchors 20 and are cast in the preformed barrier sections 13, plain studs or bolts may alternatively be used. The assembly is secured with washers 21 and nuts 22 as appropriate.

Figure 7:
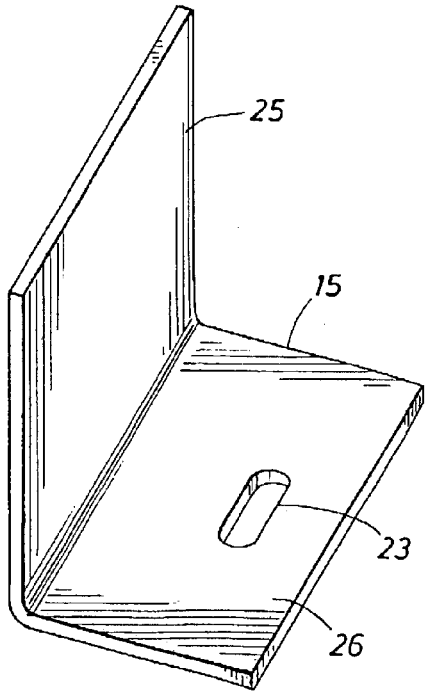
FIG. 7 is perspective view of the restraining bracket.

Referring now to FIG. 7, the restraining bracket 15 is made of one-fourth inch thick galvanized steel or like material and formed into a right angle shape with a vertical fin 25 and a horizontal base 26. Bracket 15 has a slotted hole 23 on the horizontal base to accommodate anchor bolt 18.

Figure 10:
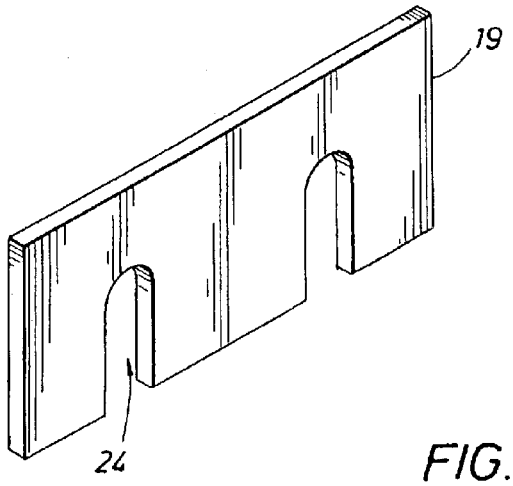
FIG. 10 is a perspective view of a shim.

Referring to FIG. 10, shim 19 is made from polymeric or like material and contains a equal number of slots 24 as the number of studs 17 which pass through it. The spacing between the slots 24 is such as to accommodate the studs 17. Shim 19 is the same thickness as the vertical fin 25 of restraining bracket 15.

Figure 8:
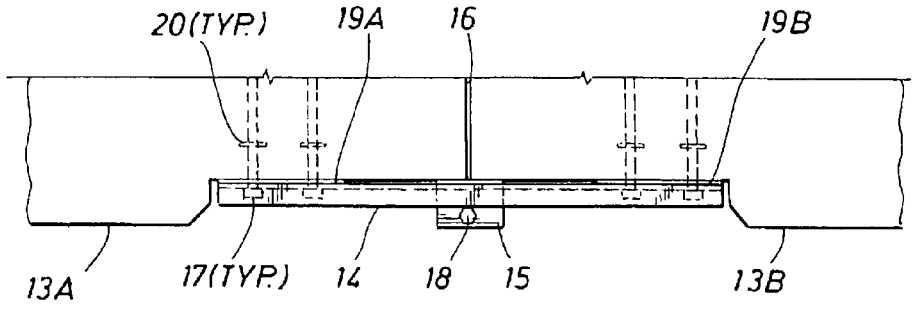
FIG. 8 is an enlarged cross section view along lines 8—8 of FIG. 3 illustrating a top view of a joint formed between two preformed barrier sections, showing a channel beam and the restraining bracket according to the present invention.
Figure 9:
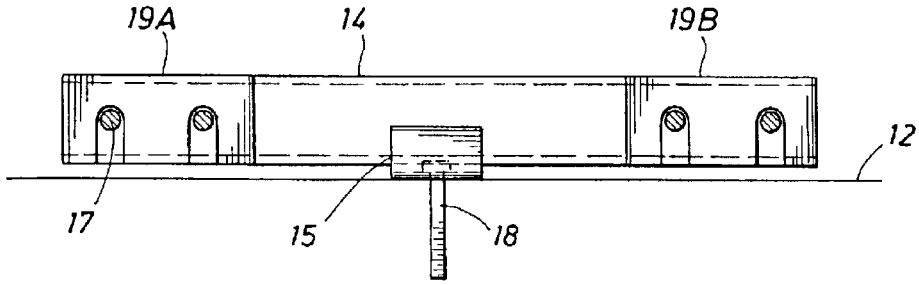
FIG. 9 is an enlarged cross section view along lines 9—9 of FIG. 4 showing the position of the restraining bracket, anchor bolt and shims in relation to the channel beam.

Shims 19A and 19B, positioned laterally between the preformed barrier sections 13A and 13B and the channel beam 14, form a narrow cavity as illustrated in FIG. 8, for placement of the vertical fin 25 of restraining bracket 15 centered longitudinally at joint 16. The horizontal base 26 of restraining bracket 15 lies parallel and adjacent to roadway surface 12. The shaft of anchor bolt 18 passes through slot 23 in the horizontal base 26 of bracket 15 and is set into a hole in the roadway 12 using thick asphalt. The restraining bracket 15 and the slotted hole 23 extend sufficiently outwardly from the channel beam 14 to allow the anchor bolt 18 to be installed without interference. The hole in roadway 12 is drilled to a depth equal to the length and at a diameter one-sixth inch larger than the diameter of anchor bolt 18.

The restraining bracket 15 and anchor bolt 18 prevent lateral movement of barrier 11, but permit longitudinal motion, the range of which is determined by the longitudinal length of the restraining bracket 15 and the distance between the innermost edges of shims 19A and 19B.

While preferred embodiments of the present invention have been illustrated in detail, it is apparent that modifications and adaptations of the preferred embodiments will occur to those skilled in the art. It is to be expressly understood that such modifications and adaptations are in the spirit and scope of the present invention as set forth in the following claims.

What is claimed is:

1. In a roadway barrier system (11) which includes, at least two barrier sections (13) positioned end to end on a roadway surface (12) of a roadway with a joint (16) defined between ends of said barrier sections, two connectors (14) positioned on opposite lateral sides of said barrier sections with each said connector overlapping ends of said barrier sections at said joint, and fasteners (17, 20, 21, and 22) extending laterally through said connectors and said barrier sections, wherein the improvement comprises, a bracket (15) having a vertical fin (25) and a horizontal base (26) having a hole (23) formed in said horizontal base, said vertical fin slideably disposed between at least one of said two connectors and a portion of at least one of said lateral sides of said barrier sections, said horizontal base of said bracket extending laterally outwardly from said two barrier sections on said roadway surface, and a bolt (18) extending through said hole of said horizontal base of said bracket into said roadway.

2. A roadway barrier system of claim 1 further comprising, first and second shims (19) with said first shim positioned longitudinally forward of said bracket (15) between said at least one of said two connectors and said lateral side of first of said barrier sections and said second shim positioned longitudinally aft of said bracket between said at least one of said two connectors and said lateral side of second of said barrier sections.

3. A roadway barrier system of claim 1 wherein, said horizontal base of said bracket having said hole formed therein extends laterally outwardly from said two barrier sections on said roadway surface such that said bolt extending through said hole of said horizontal base of said bracket into said roadway is positioned laterally outwardly from said at least one of said two connectors.

4. A roadway barrier system of claim 1 wherein, said vertical fin of said bracket is disposed between said at least one of said two connectors and said two barrier sections such that said bracket longitudinally overlaps said joint.

5. A roadway barrier system (11) comprising, at least two barrier sections (13) positioned end to end on a roadway surface (12) of a roadway with a joint (16) defined between ends of said barrier sections, two connectors (14) positioned on opposite lateral sides of said barrier sections with each said connector overlapping ends of said barrier sections at said joint, a bracket (15) having a vertical fin (25) and a horizontal base (26) having a hole (23) formed in said horizontal base, said vertical fin slideably disposed between at least one of said two connectors and a portion of at least one of said lateral sides of said barrier sections, said horizontal base of said bracket extending laterally outwardly from said two barrier sections on said roadway surface, a bolt (18) extending through said hole of said horizontal base of said bracket into said roadway, and fasteners (17, 20, 21, and 22) extending laterally through said connectors and said barrier sections.

6. A roadway barrier of claim 5 further comprising, first and second shims (19) with said first shim positioned longitudinally forward of said bracket (15) between said at least one of said two connectors and said lateral side of first of said barrier sections and said second shim positioned longitudinally aft of said bracket between said at least one of said two connectors and said lateral side of second of said barrier sections.

7. A roadway barrier system of claim 5 wherein, said horizontal base of said bracket having said hole formed therein extends laterally outwardly from said two barrier sections on said roadway surface such that said bolt extending through said hole of said horizontal base of said bracket into said roadway is positioned laterally outwardly from said at least one of said two connectors.

8. A roadway barrier system of claim 5 wherein, said vertical fin of said bracket is disposed between said at least one of said two connectors and said two barrier sections such that said bracket longitudinally overlaps said joint.

9. A method of installing a roadway barrier system (11) comprising, positioning at least two barrier sections (13) end to end on a roadway surface (12) of a roadway with a joint (16) defined between ends of said barrier sections, placing two connectors (14) on opposite lateral sides of said barrier sections with each said connector overlapping ends of said barrier sections at said joint, installing a bracket (15) having a vertical fin (25) and a horizontal base (26) having a hole (23) formed in said horizontal base, such that said vertical fin is slideably disposed between at least one of said two connectors and a portion of at least one of said lateral sides of said barrier sections, and such that said horizontal base of said bracket extends laterally outwardly from said two barrier sections on said roadway surface, installing a bolt (18) through said hole of said horizontal base of said bracket into said roadway, securing said two barrier sections, said two connectors and said bracket with fasteners (17, 20, 21, and 22) extending laterally through said two connectors and said barrier sections.

10. The method of claim 9 further comprising the steps of, installing a first shim (19) longitudinally forward of said bracket between said at least one of said two connectors and said lateral side of first of said barrier sections, and installing a second shim longitudinally aft of said bracket between said at least one of said two connectors and said lateral side of second of said barrier sections.

11. The method of claim 10 further comprising the steps of, positioning said vertical fin of said bracket between said at least one of said two connectors and said two barrier sections such that said bracket longitudinally overlaps said joint.

* * * * *